US006614040B1

(12) United States Patent
Zens

(10) Patent No.: US 6,614,040 B1
(45) Date of Patent: Sep. 2, 2003

(54) UNIT DOSE SYRINGE SHIELD AND MEASURING APPLICATOR

(76) Inventor: Albert L. Zens, 3899 Sweet Rd., Jamesville, NY (US) 13078

( * ) Notice: Subject to any disclaimer, the term of this patent is extended or adjusted under 35 U.S.C. 154(b) by 0 days.

(21) Appl. No.: 10/167,025

(22) Filed: Jun. 11, 2002

(51) Int. Cl.[7] ..... G21F 5/018

(52) U.S. Cl. ..... 250/515.1; 250/505.1; 250/506.1; 250/507.1; 604/187

(58) Field of Search ..... 250/505.1, 506.1, 250/507.1, 515.1; 604/187, 181, 195, 192, 232

(56) References Cited

U.S. PATENT DOCUMENTS

| | | | | |
|---|---|---|---|---|
| 4,092,546 A | | 5/1978 | Larrabee | |
| 4,869,299 A | * | 9/1989 | Handke | 141/1 |
| 5,413,708 A | * | 5/1995 | Huse et al. | 210/198.2 |
| 5,927,351 A | * | 7/1999 | Zhu et al. | 141/330 |
| 6,162,198 A | * | 12/2000 | Coffey et al. | 250/515.1 |
| 6,210,374 B1 | | 4/2001 | Malencheck | |
| 6,224,535 B1 | | 5/2001 | Chiu et al. | |
| 6,379,336 B1 | | 4/2002 | Asbaghi et al. | |

FOREIGN PATENT DOCUMENTS

| | | | | |
|---|---|---|---|---|
| JP | 02-095380 | * | 4/1990 | A61M/5/178 |

* cited by examiner

*Primary Examiner*—John R. Lee
*Assistant Examiner*—James P. Hughes
(74) *Attorney, Agent, or Firm*—Bond, Schoeneck & King, PLLC

(57) ABSTRACT

An apparatus that transports radiopharmaceuticals and protects individuals from radioactivity that includes a first body with a first hollow core open on a first edge and a second edge. The first hollow core surrounds an insert containing a hypodermic syringe. There is a second body with a second hollow core open on a first edge and closed on a second edge. The second hollow core surrounds the insert with the hypodermic syringe. A third body with a third hollow core open on a first edge has the third hollow core fixedly communicating with a hollow stem open on a second edge. The third hollow core surrounds the insert with the hypodermic syringe. A first connection means releasably communicates the first body with the second body and a second communication means releasably communicates with the first body and third body for providing protection from the radioactive agent. A third connection means releasably communicates the third body with a dose applicator for injecting and measuring the radiopharmaceutical in the hypodermic syringe. Finally, the dose applicator is for positioning the insert and the hypodermic syringe into and out of the first and third body whereby said individuals easily measure, transport and inject the radiopharmaceutical in the hypodermic syringe.

12 Claims, 3 Drawing Sheets

Fig. 1
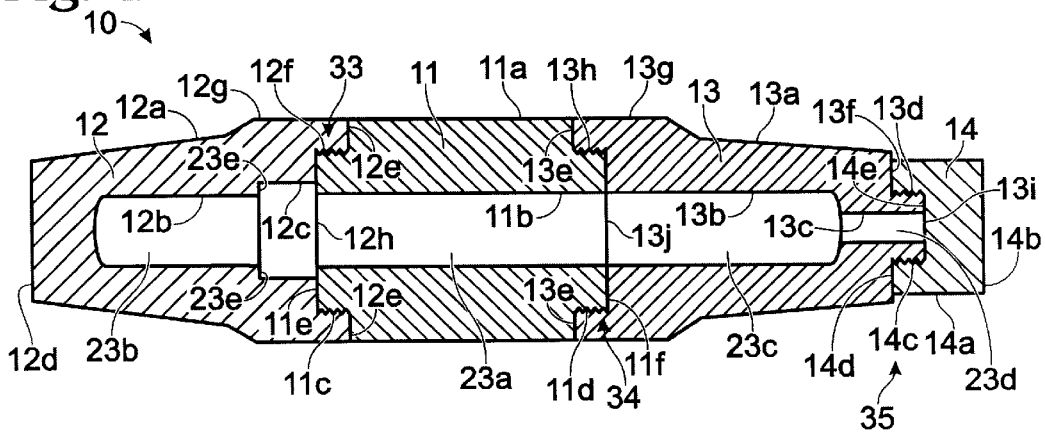
Fig. 2
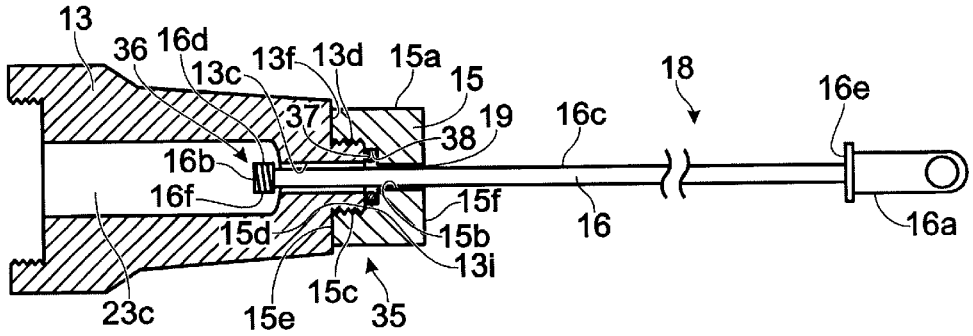
Fig. 3
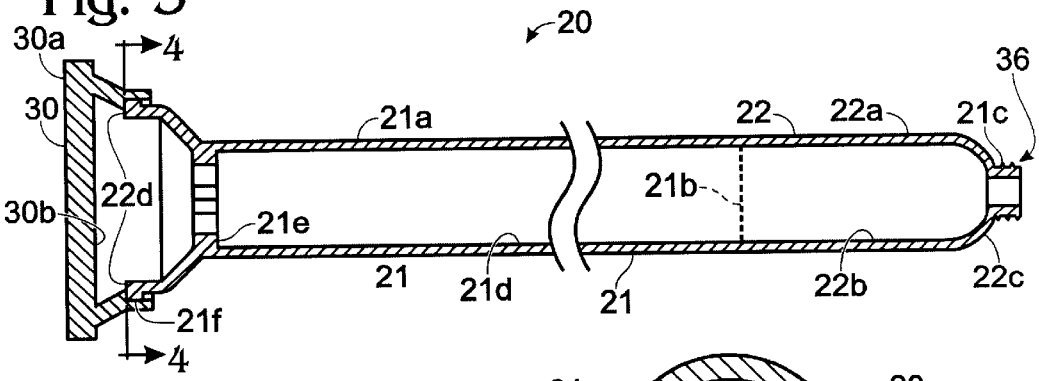
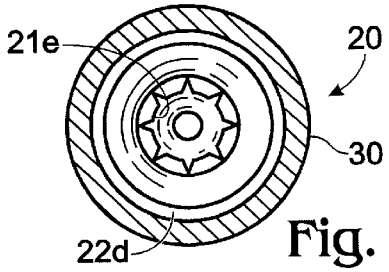
Fig. 4

UNIT DOSE SYRINGE SHIELD AND MEASURING APPLICATOR

FIELD OF THE INVENTION

This invention relates to an apparatus for transporting radiopharmaceuticals, and more particularly to a radionuclide syringe shield and dose measuring applicator.

BACKGROUND OF THE INVENTION

Radiopharmaceuticals are radioactive material which are widely used in the diagnosis and treatment of various diseases and body disorders. Radiopharmaceuticals are typically injected into the body of a patient by means of a hypodermic syringe. The repeated exposure to radioactive materials may over time present serious health hazards to the person preparing and administering the injection. This hazard is a result of radiation emanating from radioactive material which is to be injected.

Nuclear medicine technologists may receive significant radiation exposure when repeatedly handling radiopharmaceuticals, particularly high-energy radionuclides such as, for example, F-18 fluorodeoxyglucose. The technologists are particularly at risk when preparing the dose prior to injection and following injection from direct exposure to the patient. However, the latter can be avoided by increasing the distance from the patient while injecting the dose and decreasing time spent near the patient after the injection.

The exposure during the dose measuring procedure occurs when the dose is removed from the shipping container, when the dose is placed into and removed from the well counter and when the dose is inserted into the syringe shield. For example, the technologist'supper extremities receive a significant dose of radiation during the time the dose is unshielded. The prior art shields (pigs) do not allow for measurement unless the syringe is removed from them resulting in direct exposure to the technologist's upper extremities.

What is needed is an apparatus that will allow the measuring procedure to be carried out without the radionuclide being directly exposed to the technologist. What is further needed is the ability of the same apparatus to act as a syringe shield to be taken to the patient for injection.

SUMMARY OF THE INVENTION

It is an aspect of the present invention to shield the technologist from radionuclide exposure while inserting the hypodermic syringe into a well counter.

It is another aspect of the present invention to allow a measuring procedure to be carried out without the radionuclide in the hypodermic syringe being directly exposed to the technologist.

It is yet another aspect of the present invention to provide radiation shielding when the hypodermic syringe is being used to inject the patient.

To accomplish these and other aspects of the present invention an apparatus that shields radiopharmaceuticals and protects individuals from radioactivity that includes a first body with a first hollow core open on a first edge and a second edge. The first hollow core surrounds an insert containing a hypodermic syringe. There is a second body with a second hollow core open on a first edge and closed on a second edge. The second hollow core surrounds the insert with the hypodermic syringe. A third body with a third hollow core open on an first edge has the third hollow core fixedly communicating with a hollow stem open on a second edge. The third hollow core surrounds the insert with the hypodermic syringe. A first connection means releasably communicates the first body with the second body and a second communication means releasably communicates with the first body and third body for providing protection from the radioactivity. A third connection means releasably communicates the third body with a dose applicator for injecting and measuring the radiopharmaceuticals in the hypodermic syringe. Finally, the dose applicator is for positioning the insert and the hypodermic syringe into and out of the first and third body whereby said individuals easily measure, transport and inject the radiopharmaceutical in the hypodermic syringe.

These and other aspects of the present invention will become apparent from the following description, the description being used to illustrate the preferred embodiment of the invention when read in conjunction with the accompanying drawings.

BRIEF DESCRIPTION OF THE DRAWINGS

FIG. 1 illustrates the cross section view of the syringe shield without the dose measuring applicator.

FIG. 2 illustrates the cross-section view of the dose measuring applicator.

FIG. 3 illustrates the cross-section view of the insert device.

FIG. 4 illustrates the end-view of the insert device.

DETAILED DESCRIPTION OF THE INVENTION

While the present invention is described below with reference to a syringe shield, a practitioner in the art will recognize the principles of the present invention are applicable elsewhere.

Figure 5:
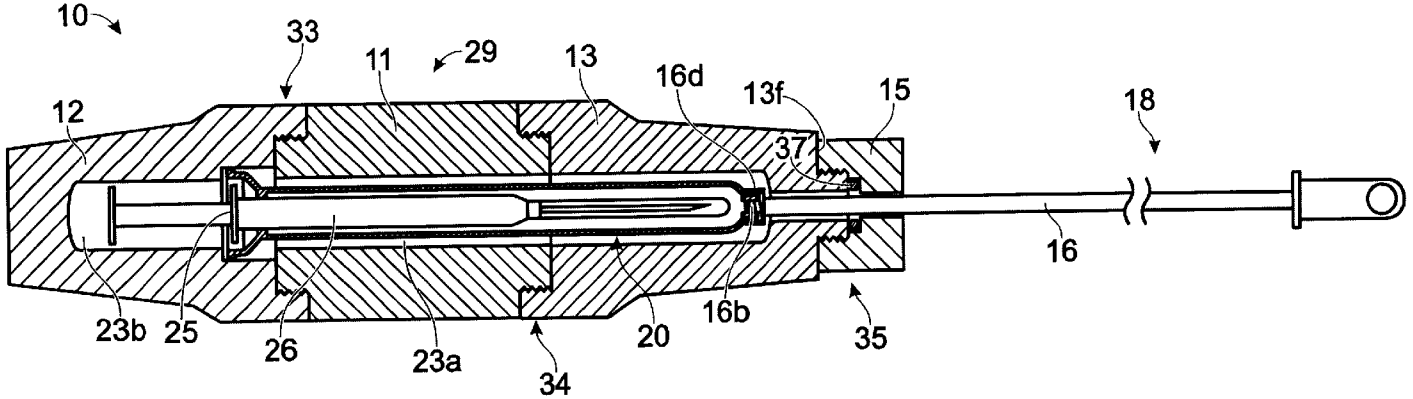
FIG. 5 illustrates the cross-section view of the syringe shield, transporter and dose measuring applicator with a hypodermic syringe.

As can be seen in FIG. 5, apparatus 10 is illustrated in a cross-section view of the syringe shield and transporter with dose applicator 18. The apparatus 10 transports a radiopharmaceutical 26 and protects individuals from radiation generated therefrom. A first body 11 releasably communicates with a second body 12 and a third body 13. The second edge first body 11*e* provides a releasably first communication means 33 with the first edge second body 12*h* between the first body 11 and the second body 12. The first edge first body 11*f* provides a releasably second communication means 34 with the first edge third body 13*j* between the first body 11 and the third body 13. A disposable insert device 20 containing a hypodermic syringe 25 is internally positioned (housed) by the first hollow core 23*a* in the first body 11. The first hollow core 23*a* is open on a first edge first body 11*f* and second edge first body 11*e*. A disposable insert device 20 containing a hypodermic syringe 25 is internally positioned (housed) by the second hollow core 23*b* in the second body 12. The second hollow core 23*b* is open on a first edge second body 12*h* and closed on the second edge second body 12*d*. A disposable insert device 20 containing a hypodermic syringe 25 is internally positioned (housed) by the third hollow core 23*c* in the third body 13. The third hollow core 23*c* is open on an first edge third body 13*j* and fixedly communicates with a hollow stem 23*d* that is open on a second edge third body 13*i*.

A first connection means 33 releasably communicates the first body 11 with the second body 12 to provide protection from radiation emitted by the radiopharmaceutical 26. A second connection means 34 releasably communicates the first body 11 with the third body 13 to provide protection from radiation emitted by the radiopharmaceutical 26. A third connection means 35 releasably communicates the third body 13 with the locking nut 15 of the dose measuring applicator 18 or cap 14 shown in FIG. 1.

An applicator rod 16 of the dose measuring applicator 18 is connected to the disposable insert 20 by a fifth female thread 16*b* at the first end 16*d* of the applicator rod 16. The applicator rod 16 slideably communicates with the third body 13 within the hollow stem 23*d* which is located between the fourth edge third body 13*f* and the third hollow core 23*c* of the third body 13. This allows the hypodermic syringe 25 with the radiopharmaceutical 26 to be positioned into and out of the first body 11 and third body 13 when the second body 12 is removed from the apparatus 10. A third connection means 35 includes a locking nut 15 that releasably secures the rod 16 of the dose applicator 18 to the third body 13. The third connection means 35 releasably communicates the locking nut inner recessed edge 15*d* and the locking nut inner edge 15*e* to the second edge third body 13*i* and the fourth edge third body 13*f* of the third body 13. The locking nut 15 releasably secures the dose applicator 18 to the third body 13 and provides an additional radiation shield 29 stopping radiation leakage from the hollow stem 23*d*. The radiation shield 29 is provided by various radiation shielding material used in the construction of the first body 11, the second body 12, the third body 13 and the locking nut 15.

In the preferred embodiment of the invention the radiation shielding material is typically lead. However, in many applications although lead is an excellent radiation shielding material it is unsuitable because it is too heavy and insufficiently flexible. Consequently, as is known by the practitioner in the art, the radiation shielding material is any material that will attenuate the photons released from the radioactive agent. For example, a radiation shielding material is obtainable from lead acrylate or lead methacrylate combined by polymerizing it at a temperature above the melting point in admixture with a copolymerizable monomer such as methyl methacrylate. Furthermore, another radiation shielding material comprises an elastomeric or rubbery plastics material filled with lead particles. These materials combine the excellent radiation shielding properties of lead with other materials that weigh less than lead to provide a good radiation shield that is flexible and not too heavy.

Another commonly utilized radiation shielding material is tungsten. When tungsten, a tungsten compound or a tungsten based alloy is used as the material with high radiation absorptivity, where the γ-ray absorption coefficient of tungsten is not less than about 1 when the energy of the γ-ray is 511 KeV or greater, there is provided a safe radiation shielding material. For example, one such tungsten compound with high radiation absorptivity is a tungsten powder that is not less than 80% by weight or greater than 95% by weight combined with vulcanized rubber. The tungsten powder in combination with the vulcanized rubber has particle sizes in the range of about 4 μg to 100 μm. When a tungsten alloy is used for the radiation shielding material a typical combination includes but is not limited to a hard-fine grained internally stressed material of tungsten and carbon or tungsten, carbon and oxygen.

Now referring to FIG. 1 the apparatus 10 is illustrated with the first body 11 communicating with the second body 12 and the first body 11 communicating with the third body 13 and a cap 14. The cap 14 communicates with the third body 13. The hypodermic syringe and disposable insert (FIG. 5) are not shown. The first body 11 has a first hollow core 23*a* that is machined all the way through body 11 from the first edge first body 11*f* to the second edge first body 11*e*. The diameter of the first hollow core 23*a* that forms the first inner surface 11*b* is a variety of sizes depending on the hypodermic syringe to be used. The first body 11 shape is defined by the first outer surface 11*a* and is typically machined.

However, as is know by the practitioner of the art that machining the first body 11 first inner surface 11*b* and first outer surface 11*a* is substitutable by casting the first body 11.

Furthermore, the first edge first body 11*f* and second edge first body 11*e* are typically formed in parallel planes. The connection means at the first edge first body 11*f* is typically a first male thread 11*d* that is formed starting at the first edge first body 11*f* at a diameter that is smaller than the first outer surface 11*a* and larger than the diameter of the first inner surface 11*b*. Typically, the first male thread 11*d* diameter is formed in the range of about 70% of the diameter of the first outer surface 11*a* and machined back from the first edge first body 11*f* about 15% the overall length of the first body 11.

The connection means at the second edge first body 11*e* is typically a second male thread 11*c* that is formed starting at the second edge first body 11*e* at a diameter that is smaller than the first outer surface 11*a* and larger than the diameter of the first inner surface 11*b*. Typically, the second male thread 11*c* diameter is formed in the range of about 70% of the diameter of the first outer surface 11*a* and machined back from the second edge first body 11*e* about 15% the overall length of the first body 11. The first male thread 11*d* and the second male thread 11*c* are typically and unified fine thread or a unified coarse thread.

Depending on the application the male thread connection means are substitutable for female threads, a locking nut arrangement or a compression flange arrangement. Finally, the first outer surface 11*a* is cylindrical in shape with a diameter that provides enough radiation shielding material between itself and the first inner surface 11*b* to protect against radiation exposure. The cylindrical shape is substitutable for any circular or polyhedron shape.

The second body 12 has a second hollow core 23*b* that is machined from the third edge second body 12*e* to a point that is about 25% of the length of the second body 12 from the second edge second body 12*d*. The diameter of the second hollow core 23*b* that forms the second inner surface 12*b* is a variety of sizes depending on the hypodermic syringe to be used. The second body 12 shape is defined by the first tapered outer surface 12*a* and second outer surface 12*g* and is typically machined. However, as is know by the practitioner of the art that machining the second body 12 second inner surface 12*b*, first tapered outer surface 12*a* and second outer surface 12*g* is substitutable by casting the second body 12. Furthermore, the third edge second body 12*e* and the second edge 12*d* second body are typically formed in parallel planes. The second connection means 34 at the third edge second body 12*e* is typically a first female thread 12*f* that is formed starting at the third edge second body 12*e* at a diameter that is smaller than the first tapered outer surface 12*a* and larger than the diameter of the second inner surface 12*b*. Typically, the first female thread 12*f* diameter is formed in the range of about 70% of the diameter of the first tapered outer surface 12*a* and machined back from the third edge second body 12*e* about 15% the overall length of the second body 12. The first female thread 12*f* is typically and unified fine thread or a unified coarse thread. However, depending on the application the female thread connection means are substitutable for a male thread, a locking nut arrangement or a compression flange arrangement.

There is an annular ridge 23*e* that is formed to provide a means for the disposable insert (shown in FIG. 5) to be coaxially secured to the third inner surface 12*c*. The diameter of the third inner surface 12*c* depends on the size of the hypodermic syringe (shown in FIG. 5) to be used. The diameter is typically the size to fit a disposable insert that accepts 3 cc and 5 cc syringes. Finally, the first tapered outer surface 12*a* and second outer surface 12*g* are cylindrical in shape with a diameter that provides enough radiation shielding material between itself and the second inner surface 12*b* to protect against radiation exposure. The cylindrical shape is substitutable for any circular or polyhedron shape.

The third body 13 has a third hollow core 23*c* that is machined from the third edge third body 13*e* to a point that is about 25% of the length of the third body 13 from the second edge third body 13*i*. The diameter of the third hollow core 23*c* that forms the fourth inner surface 13*b* is a variety of sizes depending on the hypodermic syringe to be used. The third body 13 shape is defined by the second tapered outer surface 13*a* and the third outer surface 13g and is typically machined. However, as is know by the practitioner of the art that machining the third body 13 fourth inner surface 13*b*, second tapered outer surface 13*a* and the third outer surface 13*g* is substitutable by casting the third body 13. Furthermore, the third edge third body 13*e*, the fourth edge third body 13*f*, the second edge third body 13*i* and the first edge third body 13*j* are typically formed in parallel planes. The third connection 35 means at the third edge third body 13*e* is typically a second female thread 13*h* that is formed starting at the third edge third body 13*e* at a diameter that is smaller than the third outer surface 13*g* and larger than the diameter of the fourth inner surface 13*b*. Typically, the second female thread 13*h* diameter is formed in the range of about 70% of the diameter of the third outer surface 13*g* and machined back from the third edge third body 13*e* about 15% the overall length of the third body 13.

The third connection means 35 at the second edge third body 13*i* is typically a third male thread 13d that is formed starting at the second edge third body 13*i* at a diameter that is smaller than the second tapered outer surface 13*a* and larger than the diameter of the fourth inner surface 13*b*. Typically, the third male thread 13d diameter is formed in the range of about 35% of the diameter of the third outer surface 13*g* and machined back from the second edge third body 13*i* about 15% the overall length of the third body 13. The second female thread 13*h* and the third male thread 13*d* are typically and unified fine thread or a unified coarse thread. However, depending on the application the male thread connection means is substitutable for female threads, a locking nut arrangement or a compression flange arrangement. Also, the female thread connection means is substitutable for male threads, a locking nut arrangement or a compression flange arrangement.

The hollow stem 23*d* that is formed by the fifth inner surface 13*c* is machined slightly larger than the application rod 16 that is shown in FIG. 2. The hollow stem 23*d* extends from the seventh edge 13*i* back into the third hollow core 23*c*. Furthermore, the second tapered outer surface 13*a* and the third outer surface 13*g* are cylindrical in shape with a diameter that provides enough radiation shielding material between itself and the fourth inner surface 13*b* to protect against radiation exposure. Finally, the cylindrical shape is substitutable for any circular or polyhedron shape.

The cap 14 has a cap outer surface 14*a* that is less in diameter than the narrowest diameter of the second tapered outer surface 13*a*. The cap 14 has an overall length extending from the cap inner edge 14*d* to the cap outer edge 14*b*. This length is typically about 30% of the length of the first body 11. A third connection means 35 extends from the cap inner edge 14*d* to the cap recessed edge 14*e*. The third connection means 35 is typically a third female thread 14*c* and is recessed into the cap 14 about 30% of the overall length of cap 14. However, as is known by the practitioner in the art the female thread is substitutable for a male thread, lock nut arrangement or a compression flange arrangement depending on the application. The material of cap 14 is various radiation shielding material including but not limited to, for example, tungsten or lead. The amount of material required is that which provides little or no leaking of radiation from the second edge third body 13*i*.

The syringe shield (pig), apparatus 10, as illustrated in FIG. 1 shows the cap 14 communicating with the third body 13, the third body 13 communicating with the first body 11 and the first body 11 communicating with the second body 12. The first edge first body 11*f*, the second edge first body 11*e*, the second edge second body 12*d*, the third edge second body 12*e*, the third edge third body 13*e*, the fourth edge third body 13*f*, the second edge third body 13*i*, the first edge third body 13*j* and the first edge second body 12*h* are all formed in a parallel plane to one another. The cap 14 is securely fastened to the third body 13 by axially threading the third male thread 13*d* into the third female thread 14*c* until the fourth edge third body 13*f* and the cap inner edge 14*d* are in snug-fitting contact. The third body 13 is securely fastened to the first body 11 by axially threading the first male thread 11*d* into the second female thread 13*h* until the first edge first body 11*f* and the first edge third body 13*j* are in snug-fitting contact. The first body 11 is securely fastened to the second body 12 by axially threading the second male thread 11*c* into the first female thread 12*f* until the first edge second body 12*h* and the second edge first body 11*e* are in snug-fitting contact. FIG. 1 does not show the hypodermic syringe 25 and the disposable insert 20 that is shown in FIG. 5. The cap 14 is used when only transporting the hypodermic syringe 25. Finally, in the preferred embodiment of the invention the first outer surface 11*a*, the second outer surface 12*g* and the third outer surface 13*g* are in alignment with their surface peripheries radially flush.

FIG. 2 shows the dose measuring applicator 18 communicating with and securely fastened to the third body 13. The dose applicator 18 is used when it is desired to load the hypodermic syringe 25 (shown in FIG. 5) into a well counter allowing continued radiation shielding. The dose applicator 18 consists of an applicator rod 16, a connector 16*a* and a locking nut 15. The connector 16*a* is typically an eye bolt or some other suitable connection structure such as a clip, flange, threaded pipe or the like. The connector 16*a* is attached to the rod 16 at the second end 16*e*. The outer rod surface 16*c* defines the periphery and the size of rod 16. The diameter of the outer rod surface 16*c* and the length of rod 16 varies depending on the application. At the first end 16*d* of the rod 16 is a fourth connection means 36 that is a fifth female thread 16*b* and a second section male thread 21*c* located on the disposable insert 20. Alternately, the female thread 16*b* is substitutable for a male thread in a different application. Likewise, the second section male thread 21*c* is substitutable for a female thread in a different application. The 5th inner surface 13*c* diameter is always greater in diameter than the fifth female thread connector outside surface 16*f* diameter. This allows the rod 16 to be slideably removed or inserted into the third hollow core 23*c* of the third body 13.

At the third connection means 35, a locking nut 15 connects the applicator rod 16 of the dose applicator 18 to the third body 13 allowing the rod 16 to slide but not allow the rod 16 to be completely removed from the third body 13. The locking nut 15 varies in size depending on the application with the locking nut outer surface 15*a* having a diameter that is about 60% greater than the diameter of the third make thread 13*d*. The locking nut outer edge 15*f* and the locking nut inner edge 15*e* are formed in the same parallel plane and match the parallel plane of the fourth edge third body 13*f*. A fourth female thread 15*c* is formed with a diameter that is about twice as large as the diameter of the fifth inner surface 13*c*. The depth of the fourth female thread 15*c* matches the length of the third male thread 13*d* and is formed to the locking nut inner recessed edge 15*d*. A locking nut inner surface 15*b* diameter is formed with a diameter that is slightly larger than the applicator rod outer surface 16*c* diameter. This produces a small gap 19 and because the gap is small the locking nut 15 provides additional shielding of the radiation from the radionuclide contained in the third hollow core 23*c* of the third body 13. It also allows the dose measuring applicator 18 to slideably extend into or retract from the third hollow core 23*c* of the third body 13. An o-ring 37 fits snuggly into an annular recess 38 that is formed in the locking nut inner surface 15*b* at the locking nut inner recessed edge 15*d*. The annular recess 38 is formed by machining it into the locking nut 15. However, the machining of the annular recess 38 is substitutable for casting the annular recess 38 into the locking nut 15. The o-ring 37 prevents slippage of the applicator rod 16 because the o-ring internal surface 37*a* is positioned providing a snug-fit against the applicator rod outer surface 16*c*.

After the dose measuring applicator 18 (rod 16) is inserted into the third hollow core 23*c* of the third body 13, the locking nut 15 is rotated on the third male thread 13*d*. This occurs until the fourth edge third body 13*f* tightly contacts the locking nut inner edge 15*e* and the fourth edge third body 13*f* tightly contacts the locking nut inner recessed edge 15*d*.

FIG. 3 is a cross-section illustration of the disposable insert 20. The disposable insert 20 consists of a first section 21 and a second section 22. The first section 21 is separable from the second section 22 at the insert perforation 21b. The first section inner surface 21*d* has a diameter large enough to allow a 3 cc or 5 cc hypodermic syringe to be inserted. The second section inner surface 22*b* has a diameter large enough to allow a 3 cc or 5 cc hypodermic syringe to be inserted. The first section inner surface 21*d* and the second section inner surface 22*b* typically have the same diameter that allows the first section inner surface to be radially flush with the second section inner surface. As is know in the art the first section inner surface 21*d* diameter and the second section inner surface 22*b* diameter are substitutable for various sizes depending on the size of the hypodermic syringe to be inserted into the first section 21 and the second section 22. The first section outer surface 21*a* diameter is radially flush with the second section outer surface 22*a*. The first section second outer surface 21*f* diameter is greater than the first section first outer surface 21*a*. The transition from the first section first outer surface 21*a* to the first section second outer surface 21*f* is in the shape of a tapered cylinder or a cone. The length of the cone is equivalent to the distance between the disposable insert annular ridge 23*e* and the ninth edge 12*h* as shown in FIG. 1.

The first section second outer surface 21f is about the same diameter as the diameter of the third inner surface 12*c*. The first section first outer surface 21*a* and the second section outer surface 22*a* is about the same diameter as the first inner surface 11*b* and the fourth inner surface 13*b*. The fit between the first section first outer surface 21*a* and the second section outer surface 22*a* is a snug-fit with the first inner surface 11*b* and the fourth inner surface 13*b*. A cover 30 is positioned on the second end 22*d* with a cover outer surface 30*a* and cover inner surface 30*b* defining the thickness of the cover 30. The cover inner surface 30*b* diameter is slightly larger than the first section second outer surface 21*f* diameter providing a snug-fit when the cover 30 is positioned on the second end 22*d*.

A first section annular lip 21*e* is located on the first section inner surface 21*d* where the first section first outer surface 21*a* begins transitioning to the first section second outer surface 21*f*. The first section annular lip 21*e* allows the hypodermic syringe 25, as shown in FIG. 5, to snugly-fit into the disposable insert 20. Finally, on the first end 22*c* there is a connection means that in the preferred embodiment of the invention is a second section male thread 21*c*. This second section male thread 21*c* is rotatably positioned into the fifth female thread 16*b* of the dose measuring applicator 18 as shown in FIG. 2. The second section male thread 21*c* is rotatably positioned until there is a snug-fit between it and the fifth female thread 16*b*. Alternately, the second section male thread 21*c* is substitutable for a female thread in another application. FIG. 4 shows the end view of the disposable insert with the second end 22*d* and the first section annular lip 21*e*. A hypodermic syringe (not shown) is inserted into the disposable insert 20 until it snugly-fits against the first section annular lip 21*e*.

Figure 6:
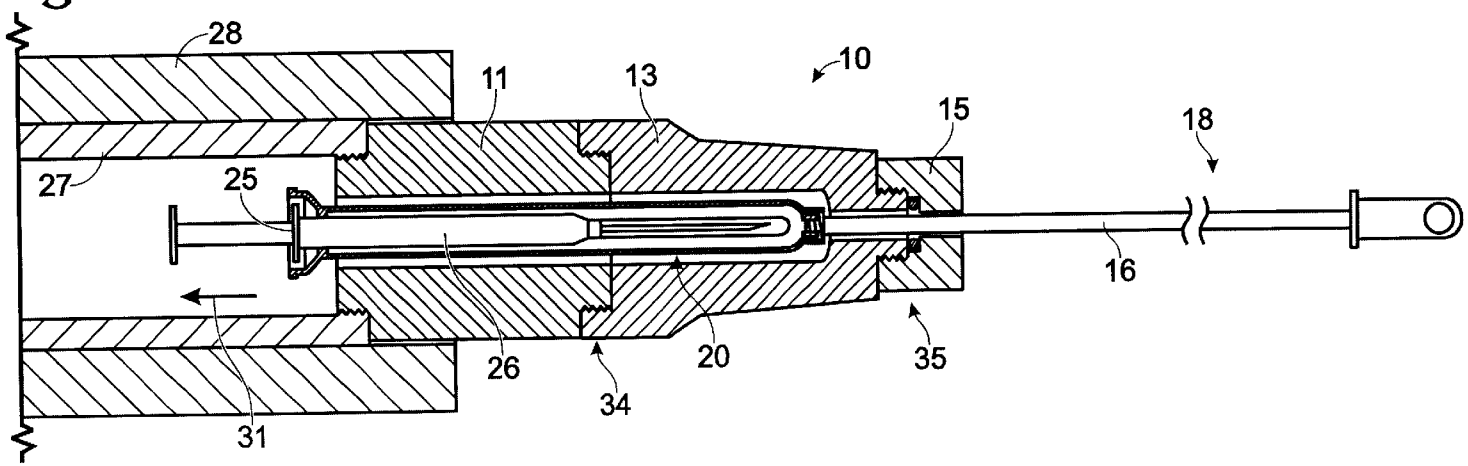
FIG. 6 illustrates the cross-section view of the syringe shield and dose measuring applicator with a hypodermic syringe being positioned into a well counter.

FIG. 6 shows apparatus 10 being loaded into a well counter 28. The well counter 28 typically has an insert 27 that the apparatus 10 is set into to allow the hypodermic syringe 25 to be loaded and measured at the well counter 28. The dose measuring applicator 18 is attached to the disposable insert 20 that has a hypodermic syringe 25 loaded into it. The apparatus 10 has the second body (not shown) removed from the first body 11 and the third body 13 before being loaded into the well counter 28. The radiation emitted from the radiopharniaceutical 26 in the hypodermic syringe is still shielded by apparatus 10 as the hypodermic syringe 25 is being loaded into the well counter 28. The dose measuring applicator 18 is pushed in the direction of the arrow 31 to load the syringe 25 into the well counter 28. The well counter typically contains shielding of radiation from the radiopharmaceutical. When the radiation from the radiopharnaceutical 26 has been measured in the well counter 28 the dose measuring applicator 18 is pulled in the opposite direction of arrow 31 inserting the disposable insert 20 that contains the hypodermic syringe back into the protective shielding of apparatus 10.

Figure 7:
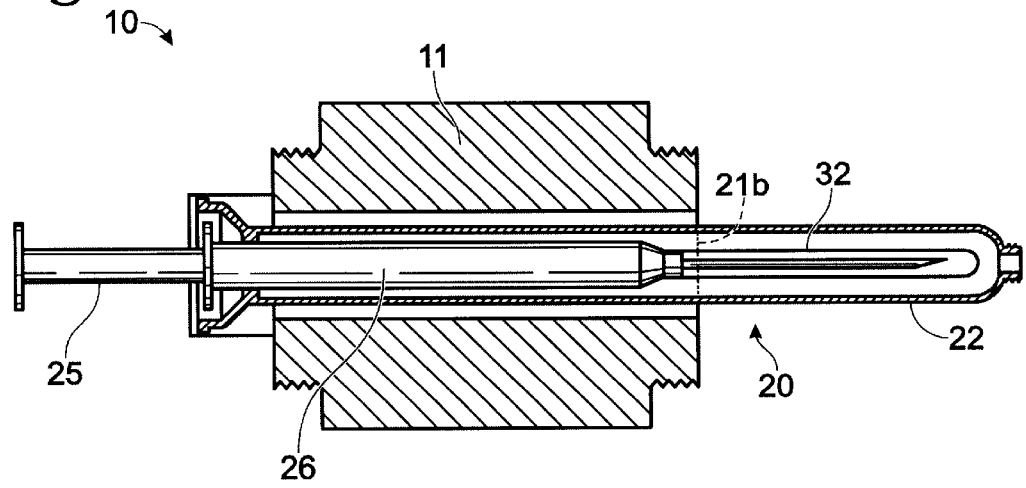
FIG. 7 illustrates the cross-section of the syringe shield with hypodermic syringe ready to be injected into a patient.

FIG. 7 illustrates apparatus 10 with the hypodermic syringe 25 in another embodiment of the invention where the radiopharmaceutical 26 in hypodermic syringe 25 can be injected into a patient. The first body 11 is the radionuclei shield surrounding the disposable insert 20 with the hypodermic syringe 25 filled with a radiopharmaceutical 26. The radiation shield is constructed of various radiation shielding materials including, but not limited to, lead and tungsten.

When the radiopharmaceutical 26 is going to be injected into a patient the second section 22 of the disposable insert 20 is removed from the first section 21 at insert perforation 21*b*. This is accomplished without exposing anyone to the radiation emanating from the radiopharmaceutical 26. The hypodermic syringe is ready to be injected into a patient once the needle cover 32 is removed.

While there has been illustrated and described what is at present considered to be the preferred embodiment of the invention, it should be appreciated that numerous changes and modifications are likely to occur to those skilled in the art. It is intended in the appended claims to cover all those changes and modifications that fall within the spirit and scope of the present invention.

What is claimed is:

1. An apparatus that acts as a shield for radiopharmaceuticals and protects individuals from radioactivity comprising:

a first body with a first hollow core that is open on a first edge and a second edge of said first body, said first hollow core for housing an insert;

a second body with a second hollow core that is open on a first edge and closed on a second edge of said second body, said second hollow core for housing said insert;

a third body with a third hollow core that is open on first edge of said third body, said third hollow core fixedly communicates with a hollow stem, said hollow stem is open on a second edge of said third body, said third hollow core for housing said insert;

said insert housing a hypodermic syringe with a radiopharmaceutical;

a first connection means wherein said first body releasably communicates with said second body for providing protection from said radioactivity;

a second connection means that said first body releasably communicates with said third body for providing protection from said radioactivity;

a third connection means for said third body to releasably communicate a dose applicator for injection and measuring said radiopharmaceutical in said hypodermic syringe; and said dose applicator for slideably positioning said insert, hypodermic syringe and radiopharmaceutical into and out of said first and third body when said secondary is removed whereby said individuals easily measure, transport and inject said radiopharmaceutical in said hypodermic syringe.

2. The apparatus as claimed in claim 1 wherein each of said first body, second body and third body is constructed of material selected from the group consisting of lead, tungsten, lead acrylate, lead methacrylate, tungsten-polymer compounds and tungsten alloy.

3. The apparatus as claimed in claim 1 wherein said hypodermic syringe has a capacity of up to 50 cubic centimeters.

4. The apparatus as claimed in claim 1 wherein the shape of each of said first body, said second body and said third body is selected from the group consisting of cylinder, tapered cylinder and combinations thereof.

5. The apparatus as claimed in claim 1 wherein said connection means is selected from the group consisting of threaded connection, locking nut and compression flange.

6. The apparatus as claimed in claim 1 wherein said means for slideably positioning said hypodermic syringe further comprises an applicator rod, a rod connector, a threaded connection and locking nut with an o-ring to securely fasten said applicator rod to said disposable insert and said third body.

7. The apparatus as claimed in claim 1 wherein said insert mechanically secures around said hypodermic syringe.

8. The apparatus as claimed in claim 1 wherein said insert further comprises a first section and a second section wherein said second section is detachable from said first section.

9. The apparatus as claimed in claim 8 wherein each of said first and second section is constructed of material selected from the group consisting of polyethylene terephthalate, high density polyethylene, polyvinyl chloride, polypropylene, tungsten-polymer compounds and combinations thereof.

10. The apparatus as claimed in claim 1 wherein said second body is removable from said first body allowing said radiopharmaceutical in said hypodermic syringe to be measured in a well counter.

11. The apparatus as claimed in claim 1 wherein said means for slideably positioning said insert is removable from said third body and replaceable with a cap for protecting said individual from said radiation when transporting said radiopharnaceutical.

12. The apparatus as claimed in claim 1 wherein said second and third body are removable from said first body for said individual to manipulate said hypodermic needle to inject a patient with said radiopharmaceuticals and be protected from said radiation.

* * * * *